United States Patent [19]

Gerhard

[11] Patent Number: 4,603,788

[45] Date of Patent: Aug. 5, 1986

[54] FREIGHT CONTAINER FOR FLOWABLE MATERIALS

[75] Inventor: Helmut Gerhard, Weitefeld, Fed. Rep. of Germany

[73] Assignee: Westerwalder Eisenwerk Gerhard GmbH, Fed. Rep. of Germany

[21] Appl. No.: 643,856

[22] Filed: Aug. 24, 1984

[30] Foreign Application Priority Data

Aug. 24, 1983 [DE] Fed. Rep. of Germany ..... 3330561

[51] Int. Cl.[4] ..... B65D 88/06; B65D 88/12; B65D 90/00

[52] U.S. Cl. ..... 220/1.5; 220/5 A; 220/18.1; 220/71; 220/72.1

[58] Field of Search ..... 220/1.5, 71, 83, 18.1, 220/72.1, 70.1, 401, 5 A; 248/DIG. 1, 674; 403/26, 267, 270, 271

[56] References Cited

U.S. PATENT DOCUMENTS

| | | | |
|---|---|---|---|
| 2,092,165 | 9/1937 | Kepler | 248/DIG. 1 |
| 2,463,880 | 3/1949 | Jones | 248/DIG. 1 |
| 3,237,896 | 3/1966 | Peterson | 248/674 |
| 3,471,053 | 10/1969 | Endicott et al. | 220/71 X |
| 3,841,253 | 10/1974 | Kircik et al. | 248/DIG. 1 |
| 4,307,812 | 12/1981 | Gerhard | 220/1.5 |

FOREIGN PATENT DOCUMENTS

| | | | |
|---|---|---|---|
| 2816845 | 10/1979 | Fed. Rep. of Germany | 220/1.5 |
| 2013624 | 8/1979 | United Kingdom | 220/72.1 |

OTHER PUBLICATIONS

Brochure by Westerwalder Eisenwerk, West Germany, ISO 1496/III, Type 74, 75, 10/78.

*Primary Examiner*—Allan N. Shoap
*Attorney, Agent, or Firm*—Barnes & Thornburg

[57] ABSTRACT

A freight container for flowable materials includes a tank (10) and diagonal members (15) which serve to accommodate longitudinal forces occurring in operation. The diagonal members (15) extend from the end groups of the container and are joined by transition pieces (20) to reinforcing rings (11) of the tank (10). Each transition piece (20) is composed of at least two brackets (20, 21) joined to the corresponding diagonal member (15) and to the reinforcing ring (11). Longitudinal bars may be fitted between the lower diagonal members of the container.

20 Claims, 8 Drawing Figures

FREIGHT CONTAINER FOR FLOWABLE MATERIALS

BACKGROUND OF THE INVENTION

The invention relates to a freight container for flowable materials, which comprises a tank with circumferentially extending reinforcing rings, end frames, and diagonal members interconnecting corner fittings of the end frames with the reinforcing rings.

According to ISO standard 1496/3, the structure of a tank container must be such that the lower corner fittings thereof alone are able to accommodate all live loads. As from a specified length containers have to be provided, in addition to said corner fittings, with at least two further load receiving zones at an axial distance between 1.7 and 2.0 m from the end frames in order to ensure an improved introduction of forces into the frame side members of the road vehicle.

In the case of frame-type tanks these bearing zones may be provided by the insertion of correspondingly rigid frame cross members in the standard region between the lower frame side members of the container. It is then possible to mount on these cross members the longitudinal or transverse saddle members through which the tank is bolted or welded to a body platform.

Moreover, an ISO container has to be dimensioned so as to be able to accommodate tensile loads and forces of pressure in longitudinal direction of the body platform of up to twice the total gross weight of the container.

In the case of frame-type tanks, these longitudinal forces occurring in operation and thus the bending forces acting on the end frames are accommodated by the frame side members of the body platform. However, they may also be accommodated by diagonal members extending approximately in the direction of the centroid of the body platform, said diagonal members introducing said forces either into a bottom beam and thus beneath the tank body or introducing them into the tank casing via suitable transition pieces.

Such a freight container, which is known from U.S. Patent Specification No. 4,307,812, is provided with face-side rectangular or square frames which are used to accommodate the hoisting and stacking forces and are joined to each other through a body platform for accommodating the axial forces. The body platform consists of one or two frame side members and of diagonal members joined to the end frames. As an advantageous embodiment there is also described therein a coupling between these diagonal members and the saddle mount of the tank container. To this end the point of intersection between the members extending diagonally towards the centre of the tank and a reinforcing ring of the cylindrical tank lies within the lower bearing zones prescribed according to ISO specifications (ISO-1496/3).

Self-supporting or "beam tanks", as they are called, in which the tank body itself accommodates the longitudinal forces and wherein no body platform is provided, present difficulties both in respect of the provided ISO bearing zones and in respect of the diversion of the longitudinal forces. Provided the forces are not accommodated by longitudinal members, the end groups of the beam tanks are subjected to considerable bending loads.

In order to provide the bearing zones for beam tanks it has been common practice to attach by welding more or less heavy saddle structures, which actually are not necessary for transporting the tank container. Consequently, there result drawbacks in respect of the dead weight and heat build-up zones in a possibly existing thermal insulation.

It is an object of the instant invention to provide also for such self-supporting tank containers a statically safe solution, which is weight-saving and easy to manufacture and satisfies the demands both in respect of the ISO bearing zones and in respect of the diversion of the longitudinal forces equally well. The joint between the tank body and the container frame shall be fatigue-proof also during long-term operation and shall permit safe introduction of the vertical bearing forces and of the longitudinal inertial forces, while the dead weight is to be low and the close ISO tolerances between respective corner fittings are observed.

SUMMARY OF THE INVENTION

The freight container of the present invention comprises a tank having reinforcing rings extending circumferentially round the tank, a pair of end frames supporting said tank, the corners of each end frame being provided with corner fittings, diagonal members having their outer ends connected to lower corner fittings of said end frames and their inner ends joined to respective ones of said reinforcing rings via transition pieces, each transition piece being composed of two brackets having first surfaces seated on the respective lower diagonal member and second surfaces extending to the two opposite sides of the respective reinforces ring. Preferably, the brackets are welded on all sides to the bearing members and the reinforcing rings.

The invention provides a weight-saving structure which reduces material expenditure, because a proper continuous body platform is not required. The diagonal members simultaneously serve to accommodate and divert the longitudinal forces and to provide the standard bearing zones.

The configuration of the transition pieces between diagonal members and reinforcing rings in accordance with the invention is a particularly simple solution of the above-specified object and is thus convenient for assembly; it allows observing of the close final tolerances by the provision of a dimensional clearance for assembly after the occurrence of possible shrinkage effects on the tank that may be caused by welding. It is possible at any time to perform corrections in longitudinal and transverse direction until the brackets have finally been fixed to the diagonal members and to the tank ring. Due to the fact that all welds are lap welds, matching to the respective actual dimensions is effected without any prestresses.

Due to the simple configuration of the transition piece consisting of two brackets, which may each be made from a single plate blank, manufacturing problems and costs are also minimized.

In mounting the tank on the diagonal members in accordance with the invention, maximum stresses and risks of fatigue are furthermore prevented due to the fact that the bearing forces and longitudinal forces are not directly transferred to the tank casing but to the inherently rigid reinforcing ring which is large-area welded about its entire circumference to the tank casing.

Preferred developments of the invention, which further improve the stability of the structure and simplify the manufacture of the container are set forth in the subclaims.

DETAILED DESCRIPTION OF PREFERRED EMBODIMENTS

Figure 1:
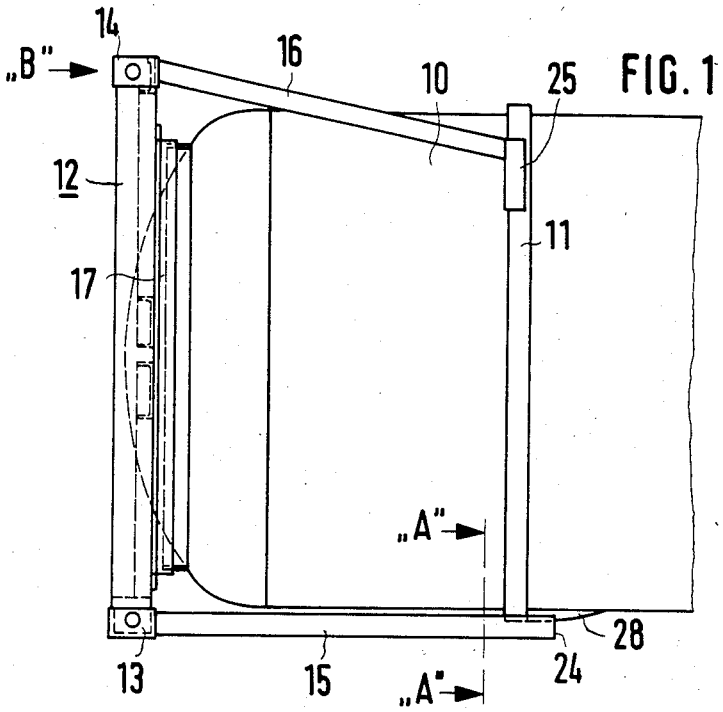
FIG. 1 is a side view of an end group of a tank container.

The end group of a freight container shown in FIG. 1 substantially comprises a rectangular end frame 12 of standard dimensions, which is joined to the tank 10 through a saddle ring 17, and lower and upper corner fittings 13, 14 for hoisting and stacking and lower and upper diagonal members 15, 16 secured thereto.

The tank 10 is provided with reinforcing rings 11, for instance in areas where bearing zones are provided in accordance with ISO standard 1496/3. These vacuum reinforcing rings 11 are inherently rigid and are welded to the tank casing about the entire circumference thereof.

Figure 2:
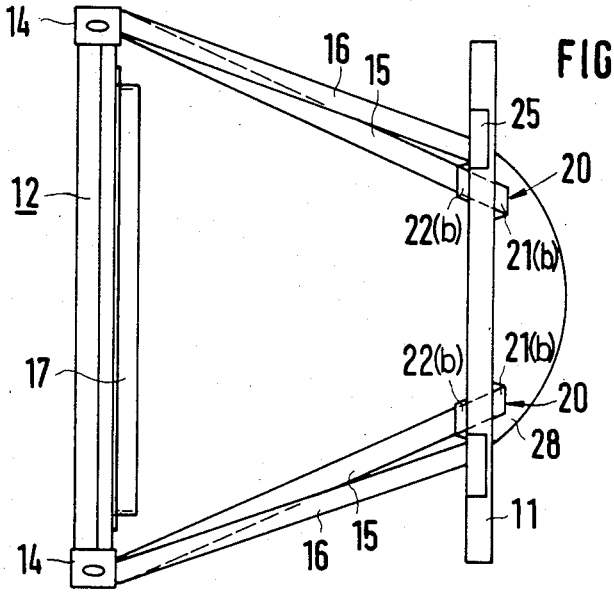
FIG. 2 is a plan view showing an end group of a tank container (without tank but including the ring)

As will be apparent from FIG. 1 and FIG. 2, the lower diagonal members 15 are joined to the lower corner fittings 13 and extend at an acute angle relative to the longitudinal axis of the tank obliquely inwardly substantially to the level of a reinforcing ring 11 of the tank 10. The point of intersection between lower diagonal members 15 and reinforcing ring 11 is approximately in the region of the prescribed ISO bearing zones, i.e., within a longitudinal range between 1.7 and 2.0 m and a width-wise range between 0.7 and 1.2 m. The connection between diagonal members 15 and reinforcing ring 11 is made in these regions by means of the transition pieces 20, through which the longitudinal forces and bearing forces acting on the diagonal members 15 are introduced into the reinforcing rings 11 of the tank.

Figure 3:
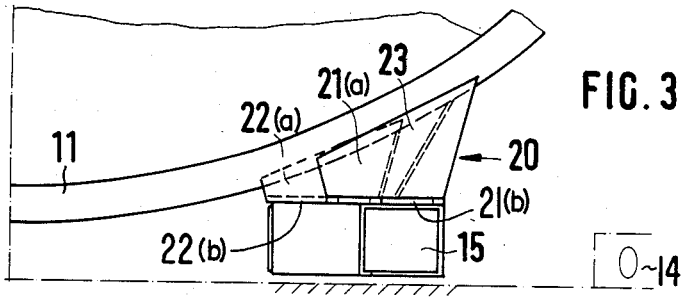
FIG. 3 is a partial view along the line "A—A" of FIG. 1.
Figure 4:
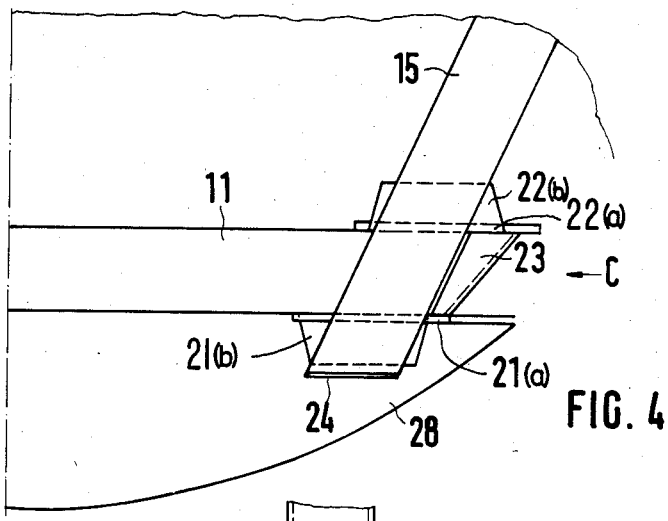
FIG. 4 is a plan view showing a transition piece in accordance with an embodiment of the invention.
Figure 5:
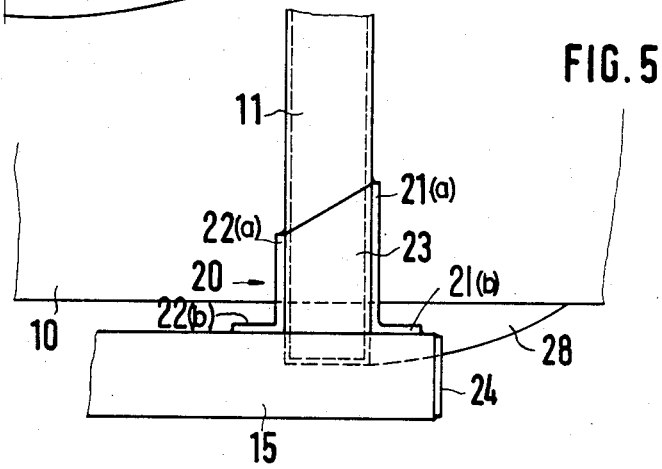
FIG. 5 is a view according to "C" in FIG. 4 (rotated by 90°)

The FIGS. 3 to 5 are three different views showing the joint between a tank reinforcing ring 11 and a lower diagonal member 15 by means of a transition piece 20 in accordance with a preferred embodiment of the invention.

The transition pieces 20 are composed of at least two brackets 21(*a,b*) and 22(*a,b*). Each of said brackets is made of a substantially trapezoidal integral plate blank with the lower portion 21(*b*), 22(*b*) thereof folded at substantially right angles and facing said diagonal members 15, and the upper portion 21(*a*), 22(*a*), facing said reinforcing rings 11. When the tank 10 has been secured in the retainers 17 of the end frames 12, the two brackets 21 and 22 are moved on the diagonal members 15 to either side of the reinforcing ring 11 and are welded thereto and to the diagonal members on all sides.

This solution is highly convenient for assembly, because the height dimensions may be accurately fixed and corrected until the brackets are finally welded.

The stability of the transition pieces 20 may additionally be increased by inserting a tie member 23 in the region between the brackets 21 and 22, the reinforcing ring 11 and the diagonal members 15. Like the two brackets, the tie member 23 also is made of an integral square plate blank. A further tie member—not shown—which is inserted in the above-mentioned region on the side of the diagonal member opposite to the tie member 23, causes further strengthening of the supporting zone.

All welds made in the region of the transition pieces 20 are fillet welds or lap weld joints, whereby matching to the diagonal members and to the reinforcing ring without any prestresses becomes possible.

The open ends of the lower diagonal members 15 are closed by an end plate 24 or by a frame cross member ending thereat, provided an additional frame side member is provided as lateral protection against damage so that open cavities, whose interior surfaces might corrode in saline or otherwise malevolent atmosphere, can be avoided.

The additional relief shell 28 shown in FIGS. 1, 2, 4, and 5 is butt welded to the tank casing and the reinforcing ring 11. It is formed of an integral sheet metal blank having the shape of a spherical shell sector. This measure ensures safe introduction of forces into the tank casing even when high horizontal longitudinal forces occur. Instead of the one relief shell 28 shown, which is allocated to both diagonal members 15, it is also possible to provide two smaller shells in the region of the joint between each diagonal member 15 and the reinforcing ring 11.

The upper diagonal members 16 shown in FIGS. 1 and 2 divert the bending forces acting on the upper corner fittings 14 of the end frame 12 to the tank body. The upper diagonal members 16 are either welded or bolted to the upper corner fittings 14 and extend obliquely inwardly and downwardly till the reinforcing ring 11 of the liquid tank 10. Bearing plate members 25 are welded to that side of the reinforcing ring 11 which faces the end frame 12, the corresponding upper diagonal members 16 being joined to said plate members.

Figure 6:
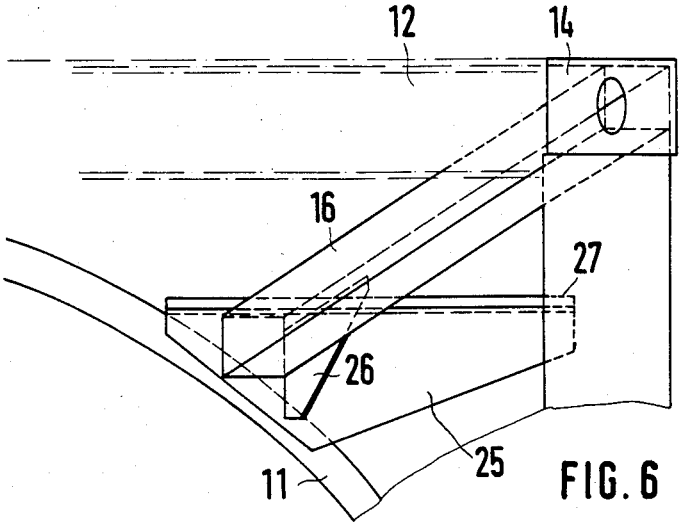
FIG. 6 is a view according to "B" in FIG. 1.

The bearing plate members 25 shown in FIG. 6 are also made from an integral folded plate blank, matched to the reinforcing ring 11 and welded thereto over a large area. The bearing plate members 25 allow good joining of the upper diagonal members 16 to the tank body and thus a proper introduction of forces into the reinforcing ring 11. The joint may be strengthened by a tie member 26 inserted into the region between the upper diagonal member 16, the bearing plate member 25 and the reinforcing ring 11. Said tie member 26 is a substantially triangular plate blank. It is butt welded to the bearing plate member 25 and large-area lap welded to the upper diagonal member 16.

As shown in FIG. 6, the bearing plate member 25 is shaped such that it may simultaneously be used as support for a catwalk 27 extending in longitudinal direction of the tank.

The described joint between the container end frames and reinforcing rings of the liquid tank through diagonal members is convenient to assemble and to adjust and ensures uniform transfer and distribution of all forces occurring in operation to the tank circumference. In this connection, the transition pieces provided between the lower diagonal members and the reinforcing rings simultaneously serve the purpose of introducing the longitudinal forces acting on the diagonal members into the tank body and of accommodating the vertical bearing forces in the region of the prescribed ISO bearing zones.

Figure 7:
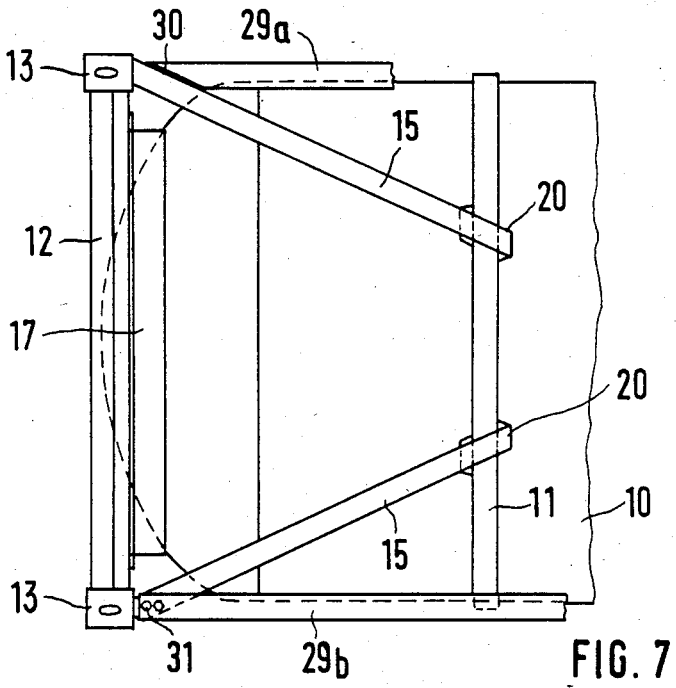
FIG. 7 is a bottom view of a tank container according to another embodiment of the invention.
Figure 8:
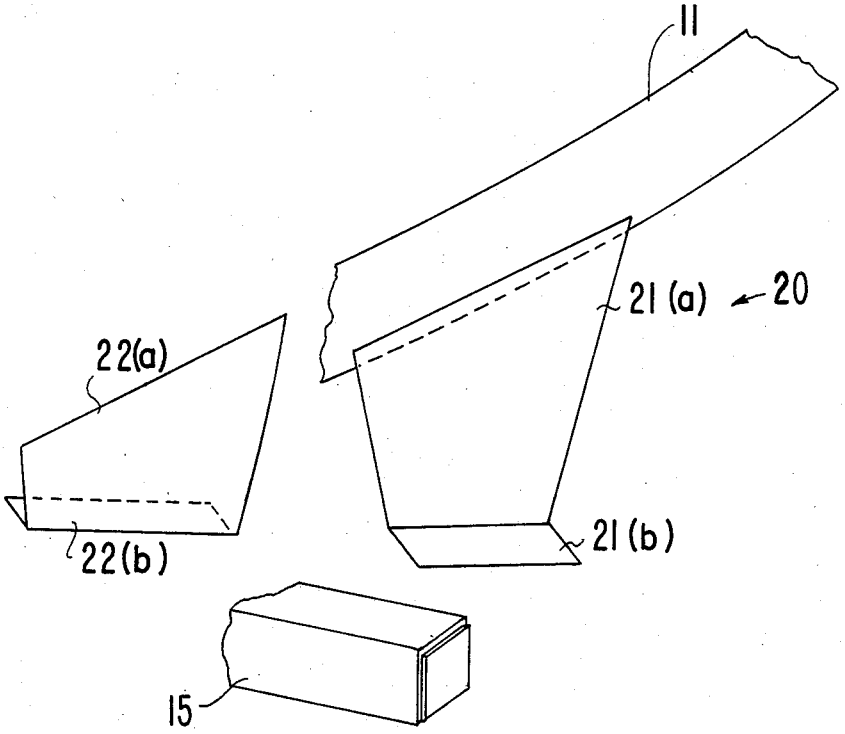
FIG. 8 is an exploded perspective view of the transitional piece in FIG. 3.

In the container shown in FIG. 7, longitudinal bars 29*a* and 29*b* are connected to the lower diagonal members 15 in the vicinity of the corresponding corner fittings 13. The longitudinal bar 29*a* is shown to have its end cut at an angle corresponding to the angle between the diagonal member 15 and the longitudinal axis of the tank to achieve flush abutment on the diagonal member 15 to which it may be welded as shown at 30. The end of the other longitudinal bar 29*b* is shown as encompassing the respective diagonal member 15, specifically engaging the bottom side thereof. In this alternative, the connection may be made by means of bolts 31, as shown, or again by welding.

Since the longitudinal bars 29*a* and 29*b* are not connected directly to the corner fittings 13, as in conventional container frames, but have their ends laterally fitted to the diagonal members 15, tolerances in the longitudinal dimensions can be compensated during assembly of the frame. Any deviation from a specified length only results in a small shift of the longitudinal bar towards or away from the center axis of the tank without causing problems in assembling the container frame or stresses between the frame and the tank in the assembled state.

The longitudinal bars 29*a*, 29*b* have C or L section. They can thus be placed on the sides of the diagonal members 15 and then moved relatively thereof until they properly extend along the longitudinal direction. Since the ends of the longitudinal bars abut the diagonal members with comparatively large areas, a sturdy connection between these elements can be achieved. In welding the longitudinal bar 29*b* to the diagonal member 15, the connection may be formed as a lap weld.

Due to the fact that the longitudinal bars 29*a* and 29*b* are inserted between the diagonal members 15 provided in the regions of the two container end frames, they are adapted to absorb longitudinal forces which may be exerted on the end frames in operation. In addition, the longitudinal bars 29*a*, 29*b* provide lateral protection of the tank 10 against damages as may occur during handling or collisions. Repairing such damages which may affect a thermal insulation of the tank and an envelope covering such insulation are known to be very costly. For this reason, it is preferred that the longitudinal bars 29*a*, 29*b* be screwed to the diagonal members 15, just as should be the end frames 12 with respect to the tank 10 and the diagonal members 15 with respect to the reinforcing rings 11, so that these elements are readily disassembled and exchanged, thereby simplifying repairs of any damages. Such screw connections are particularly suitable if the ends of the longitudinal bars have C or L section as mentioned above because the bolts 31 may simply extend through the longitudinal bars and diagonal members and are readily accessible.

The end of the longitudinal bar 29*b* partially encompasses the diagonal member 15 as shown in FIG. 7. Accordingly, the leg of the bar 29*b* abutting the bottom side of the diagonal member 15 may serve for engagement by grappler arms as can be used for handling the container in accordance with the pertinent ISO and UIC standards.

In case upper diagonal members (corresponding to the members 16 in FIG. 2) are provided between upper corner fittings of the container end frames 12 and the respective reinforcing rings 11, additional longitudinal bars may be inserted between such diagonal members, which may be useful for increasing the rigidity of the frame structure.

I claim:

1. A freight container arrangement comprising:

a tank means having a generally cylindrical body;

two end frame means joined to the respective opposite ends of said tank means, said frame means including corner fitting means provided at each corner of said frame means;

a plurality of reinforcing rings extending circumferentially about the exterior of said tank means;

a plurality of diagonal members having their outer ends connected to respective corner fitting means of said end frame means and their inner ends joined to respective reinforcing rings;

and connecting means interposed between respective diagonal members and reinforcing rings for connecting the same together, said connecting means being in the form of bracket means having first and second surfaces, said first surfaces being seated on respective diagonal members and said second surfaces extending to opposite sides of the respective reinforcing ring, said first and second surfaces being angularly inclined with respect to one another, wherein said bracket means are movable on said diagonal members on either side of said reinforcing ring prior to connecting thereto, thereby accommodating for possible shrinkage effects on the tank means which may occur during assembly of the same with minimization of stresses resulting in the finished assembly.

2. The arrangement of claim 1, wherein said reinforcing ring includes a pair of laterally spaced sides for forming two legs of a C-section.

3. The arrangement of claim 1, further comprising a tie member wherein said bracket means includes a pair of brackets having said tie member disposed therebetween and extending transversely thereof.

4. The arrangement of claim 1, wherein the second surfaces of said bracket means increase in width from said diagonal members toward the respective reinforcing ring.

5. The arrangement of claim 1, further comprising additional diagonal members connecting upper corner fitting means of said end frames to said reinforcing ring.

6. The arrangement of claim 5, further comprising bearing plates attached to the sides of said reinforcing rings faced said end frames, said additional diagonal members being joined to said bearing plates.

7. The arrangement of claim 6, wherein the joint between the end of the respective additional diagonal member and the respective bearing plate is strengthened by a tie member extending in the direction of said diagonal member.

8. The arrangement of claim 5, wherein said additional diagonal members extend obliquely inwardly and downwardly from said upper corner fitting means.

9. The arrangement of claim 6, wherein said bearing plates constitute supports for a catwalk extending longitudinally of said tank means.

10. The arrangement of claim 1, wherein said diagonal members have rectangular sections.

11. The arrangement of claim 1, including a relief shell inserted between said tank means and said reinforcing ring.

12. The arrangement of claim 1, including longitudinal bars extending in the longitudinal direction of said tank means and having their ends connected to said diagonal members in the vicinity of the respective corner fitting means.

13. The arrangement of claim 12, wherein the ends of said longitudinal bars are cut at an angle corresponding to the angle between the longitudinal axis of said tank means and said diagonal members and are welded to the latter.

14. The arrangement of claim 12, wherein the ends of said longitudinal bars engage said diagonal members at least at the bottom sides thereof.

15. The arrangement of claim 12, wherein said longitudinal bars are adapted for engagement by grappler arms.

16. A freight container for flowable materials comprising:

a tank having reinforcing rings extending circumferentially around the tank, a pair of end frames supporting said tank, the corners of each end frame being provided with corner fittings, and diagonal members having their outer ends connected to respective corner fittings of said end frames and their inner ends joined to respective ones of said reinforcing rings via transition pieces, each transition piece being composed of two brackets having first surfaces seated on the respective diagonal member and second surfaces extending to the two opposite sides of the respective reinforcing ring, said first and second surfaces being angularly inclined with respect to one another;

wherein the second surfaces of said brackets increase in width from said diagonal members towards the respective reinforcing rings.

17. A transitional connection arrangement for freight containers of the type having:

a tank means;

two end frame means joined to the respective opposite ends of said tank means, said frame means including corner fitting means provided at each corner of said frame means;

a plurality of reinforcing rings extending circumferentially about the exterior of said tank means; and a plurality of diagonal members having their outer ends connected to respective corner fittings means of said end frame means and their inner ends joined to respective reinforcing rings; said arrangement comprising:

connecting members interposed between respective diagonal members and reinforcing rings for connecting the same together, said connecting members being in the form of bracket means having first and second surfaces, said first surfaces being seated on respective diagonal members and said second surfaces extending to opposite sides of the respective reinforcing ring, said first and second surfaces being angularly inclined with respect to one another, wherein said bracket means are movable on said diagonal members on either side of said reinforcing ring prior to connecting thereto, thereby accommodating for possible shrinkage effects on the tank means which may occur during assembly of the same with minimization of stresses resulting in the finished assembly.

18. The arrangement of claim 17, wherein said reinforcing ring includes a pair of laterally spaced sides for forming two legs of a C-section.

19. The arrangement of claim 17, further comprising a tie member formed of a plate means, wherein said bracket means includes a pair of brackets having said tie member disposed therebetween and extending transversely thereof.

20. The arrangement of claim 17, wherein the second surfaces of said bracket means increase in width from said diagonal members towards the respective reinforcing ring.

* * * * *